United States Patent [19]

Hirono et al.

[11] 4,210,695

[45] Jul. 1, 1980

[54] METHOD OF FORMING COLORED PATTERNS ON ALUMINUM OR ITS ALLOYS

[75] Inventors: Hatsuo Hirono, Nyuzen; Katsuyuki Nagata, Vozu; Nobushige Doguchi, Toyama, all of Japan

[73] Assignee: Yoshida Kogyo K.K., Tokyo, Japan

[21] Appl. No.: 964,465

[22] Filed: Nov. 29, 1978

[30] Foreign Application Priority Data

Dec. 5, 1977 [JP] Japan ..... 52-145191

[51] Int. Cl.[2] ..... C23B 9/02

[52] U.S. Cl. ..... 428/209; 428/469; 204/33; 204/35 N; 148/6.1; 156/665; 156/659.1; 427/280

[58] Field of Search ..... 118/402; 427/434 A, 427/280, 281; 204/18 R, 35 N, 33, 38 A; 428/106, 209, 213, 469; 148/6.1

[56] References Cited

U.S. PATENT DOCUMENTS

| | | | |
|---|---|---|---|
| 135,039 | 1/1873 | Johnston | 156/659 |
| 2,085,988 | 7/1937 | McNally | 204/18 R |
| 2,556,626 | 6/1951 | Meulendyke | 156/659 |
| 2,993,847 | 7/1961 | Poch | 156/659 |
| 3,284,321 | 11/1966 | Fromson | 204/18 R |
| 3,450,606 | 6/1969 | Darrow | 204/18 R |
| 3,839,163 | 10/1974 | Kaneda et al. | 204/18 R |
| 3,874,949 | 4/1975 | Kaneda et al. | 148/6.27 |
| 4,066,516 | 1/1978 | Sato | 204/18 R |
| 4,091,126 | 5/1978 | Hidan | 118/402 |

FOREIGN PATENT DOCUMENTS

| | | | |
|---|---|---|---|
| 19395 | of 1892 | United Kingdom | 427/259 |

*Primary Examiner*—Ralph S. Kendall

*Attorney, Agent, or Firm*—Hill, Van Santen, Steadman, Chiara & Simpson

[57] ABSTRACT

A colored pattern imitating the grain of wood is formed on the surface of an article formed of an aluminum or its alloy by dipping the article in a coating bath floating a coating material in a multilinear pattern or multiannular pattern to form on the surface of the article a masking film in a pattern of the wood grain, subjecting the article to an oxide film application or etching and, after removal of the masking film, subjecting the article to an electrolytic coloring process.

6 Claims, No Drawings

METHOD OF FORMING COLORED PATTERNS ON ALUMINUM OR ITS ALLOYS

BACKGROUND OF THE INVENTION (1) Field of the Invention

This invention relates to methods of forming colored patterns on the surfaces of aluminum or its alloys without using any dyes or pigments and to an aluminum article having a colored pattern of wood grain.

(2) Description of the Prior Art

Hitherto, there have been known many methods of forming colored patterns on the surfaces of aluminum or its alloys. In prior methods, as disclosed in Japanese Patent Publication No. 3895/77 and 4616/75 and Japanese Patent Application laid open to public inspection No. 41735/75, a resist film is applied to or printed on an aluminum work piece to form protected areas in conformity with a desired pattern, the work piece is then subjected to an anodic oxidation to form a barrier-type oxide film or to a chemical conversion to form a chemically oxidized film and, after removal of the resist film, to the second anodic oxidation or chemical conversion to form a pattern of a colored film, namely, the prior methods include the steps of: resist pattern printing, primary anodic oxidation, (stopping-up of pores), removal of resist film, secondary anodic oxidation (electrolytic coloring); or, resist pattern printing, chemical oxide film formation, removal of resist film, chemical conversion (chemical formation of colored oxide film). Another method which also includes a printing process for patterning is disclosed in Japanese Patent Publication No. 21022/76 which comprises applying a TFS coating to the surface of an aluminum work piece, applying a pattern coating thereon by means of screen or off-set printing and drying and baking together the TFS coating and the patterning ink. These methods which include a printing process for patterning, however, have a shortcoming that the printing process is expensive and takes much time and, consequently, results in decrease in the mass productivity or productivity of these methods and, in addition, the printing process makes it difficult to produce a variety of patterns each at relatively small produce.

As a method which includes no printing process, Japanese Patent Application laid open to public inspection No. 60244/77 discloses a method of electrolytically coloring aluminum to form a pattern of wood grain which comprises subjecting an aluminum work piece to electrolysis in an alkaline electrolytic bath added with a barrier-type oxide film forming electrolyte by means of an alternating current or a current exhibiting the same effect with an alternating current. Japanese Patent Application laid open to public inspection Nos. 3535/77, 61139/77 and 70951/77 disclose methods of forming patterns on aluminum surfaces by electrolytic coloring through controll of electrolytic formation of a barrier layer after anodic oxidation. However, these methods in which colored patterns are formed by electrolytic coloring after modification of the thickness of the barrier layer are unsuitable for work piece having complicated shapes and poor in productivity because of difficulty in modification of the thickness of the barrier layer. On the other hand, the method disclosed in Japanese Patent Application laid open to public inspection No. 60244/77 is applicable to work pieces having complicated shapes, though the patterns formed in this method are lengthwise extending short etching figures which are somewhat similar to but far apart from the straight grain of natural wood and it is impossible to form patterns imitating the cross or flat grain of wood.

SUMMARY OF THE INVENTION

Accordingly, it is a principal object of the present invention to provide a method of forming a colored pattern with a close resemblance to a straight or cross grain of natural wood without using any dyes or pigments on the surface of aluminum or its alloy.

Another object of the present invention is to provide a method of forming wood grain patterns having a stereographic effect on the surface of aluminum or its alloy without using a printing process.

Still another object of the present invention is to provide an aluminum article having a colored pattern which resembles closely to a straight or cross grain of natural wood.

A further object of the present invention is to provide an aluminum article having a colored pattern of wood grain with a stereographic effect.

The above-mentioned objects of the present invention can be performed by a method which is characterized by the dip coating process which enables easily to form a mask coating in the pattern of a straight or cross grain of wood on the surface of an aluminum work piece and also by the etching process after the masking process which enables to form a wood grain pattern having a stereographic effect.

DETAILED DESCRIPTION OF THE INVENTION

Now, in accordance with the present invention, an aluminum or its alloy, hereinafter referred to as "work piece", is subjected to degreasing, washing, drying and other conventional pretreatments and, optionally, to etching, desmutting and like special treatments and then dipped in a coating bath floating a coating material in a multilinear or multiannular pattern to deposit thereon a wood grain pattern. In case where the coating material floats in the multilinear pattern, there is formed a pattern of a straight wood grain, and where it float in the multiannular pattern or pattern of water rings, there is formed a pattern of a cross grain of wood. The work piece is then drawn up from the coating bath and dried in the air or in an appropriate heating chamber to form a coating film in the pattern of a wood grain. The residue of the coating material floating in the surface of the coating bath deposits on the surface of the work piece as it drawn up from the bath, but the deposits can easily be removed by treating in a washing bath equipped with, e.g., an air agitator because of the loose adhesion of the deposits to the wetted surface of the work piece. In case where the washing with water is omitted, it is desired to draw up the work piece after removal of the residual coating layer by overflow of the coating bath.

The work piece thus masked with a coating film in the pattern of a wood grain is, after washing and other optional processes, subjected to a surface modifying process. The surface modifying process aims as its purpose to make a difference in surface property between the masked areas and the unmasked areas in the course of the following anodic oxidation where there is formed an oxidized film such as, e.g., a chemically oxidized film, an anodic oxide film or a colored anodic oxide film and a barrier-type oxide film by the known methods. The chemically oxidized film is formed by dipping the work piece into a solution containing chromate, phosphate, acetate, sulfate, nitrate, fluoride, etc.. The anodic oxide film is formed by electrolytically oxidizing the work piece in an acid electrolyte, such as sulfuric acid, oxalic acid, chromic acid, etc. and the colored anodic oxide film is formed by using an electrolyte containing at least one of the organic acid selected from oxalic acid, malonic acid, sulfo-salicylic acid, sulfo-phthalic acid, citric acid, maleic acid, tartaric acid, etc. or a mixture solution of inorganic acid with said organic acid. The barrier-type oxide film is formed by a high voltage electrolysis in an inorganic or organic acid electrolyte, such as boric acid, citric acid, tartaric acid, maleic acid, glycolic acid or salt thereof.

The work piece is then, after removal of the masking film by means of, e.g., a solvent, sulfuric acid or an organic remover, subjected to an electrolytic coloring by the known methods. One of the electrolytic coloring processes is carried out by anodic oxidation in an ordinary electrolytic bath containing an organic acid, such as oxalic acid, malonic acid, citric acid, maleic acid, tartaric acid, sulfo-salicylic acid, etc.. Another electrolytic coloring process is carried out by anodic oxidation using an acid electrolyte, such as sulfuric acid, oxalic acid, chromic acid, etc. and following electrolysis using an acid electrolyte containing a metalic salt, such as nitrate, sulfate, phosphate, oxalate, acetate, tartrate, etc. of nickel, chrome, cobalt, copper, magnesium, iron, manganese, molybdenum, lead, zinc, etc.. The work piece may be subjected, if necessary, to washing with water, drying and other pretreatments before the electrolytic coloring.

In another embodiment of the present invention, a work piece is, after masking with a coating film in the pattern of a wood grain in the same way as mentioned above, subjected to an etching as surface modifying process. This etching process results in a finished product having a touch substantially same with that of natural wood and a rough surface appearance. The subsequent treatments are carried out in the same ways as mentioned above.

The aforesaid mask coating is carried out in the procedure as follows. A coating material is poured on to the surface of a coating bath filled up with slowly flowing water from the up-stream end of the bath as to form a number of streaks floating on the surface of water. Flow of the bath and feed of the coating material are stopped just before the front ends of the extending streaks of the coating material arrive at the overflow end of the bath, and a work piece which is hung down lengthwise is dipped in the bath to deposit on its surface the floating coating material in a pattern of wood grain. For this process, it is preferred that the work piece has previously been well dried and is hung down lengthwise and that the width of the coating bath is $\frac{1}{2}$ to $\frac{2}{3}$ times the length of the work piece. When the width of the coating bath is not enough, the coating material should be continuously poured in the coating bath at a feed rate so controlled as to form the continuous thin streaks like wood pattern on the surface of the work piece with respect to the dipping speed of the work piece. The floating streaks of the coating material may also be formed by feeding the coating material to the end opposite to the overflow end of the coating bath to accumulate therein the coating material and spreading it towards the overflow end by means of a blade having notches at intervals in its bottom edge. When the mask coating is carried out in this procedure, there is formed a mask coating in a pattern of straight grain of wood.

In order to form a pattern of cross grain of wood, the coating material is dropped to the surface of coating bath to form thereon a multiannular pattern or pattern of water rings and the dropping of the coating material is continued at a rate suitable to the dipping speed of the work piece.

Water is usually used for floating the coating material, though the workability of the coating bath is improved by adding thereto a surface-active agent.

Coating materials suitably used for patterning are acrylic resin coatings such as, e.g., modified acrylic lacquers (acrylic resin/nitrocellulose), alkyd resin coatings such as, e.g., high solid lacquers (benzoic acid modified alkyd resin/nitrocellulose) and the like, but is not restricted thereto.

Since it is necessary for obtaining a finely finished pattern to prevent break-up of the streaks of the coating material, is it occasionally preferred to reinforce the coating layer by incorporating therein a small amount of microfilm.

As illustrated above, in accordance with the present invention a fine wood grain pattern can be applied to the whole surface of a work piece by processing it in lengthwise hung-down state even if it is of a complicated shape, because the patterned mask coating is carried out in a dip coating process. The method of the present invention can be carried out as a step in an alumite line in which work pieces are processed in lengthwise hung-down state. The work pieces may be colored by subsequent modifying process and electrolytic coloring process into bronze, amber, silver, gold and various other tones. The colored pattern prepared by the method of the present invention exhibits excellent durability, i.e. excellent weathering resistance and corrosion resistance when used as exterior material of buildings.

It is one of characteristic features of the present invention that, since mask coating is deposited on the work piece from a floating layer of a coating material over liquid surface, there are obtained colored patterns which resemble closely to but not identical with each other.

The colored pattern in accordance with the present invention may be made more corrosion and weathering resistant by applying thereto a clear lacquer in spray, dip or electrodepositing coating process.

The present invention will now be illustrated in more detail by the following examples.

EXAMPLE 1

An aluminum extruded sheet A-6063s of a length of 20 cm and of a width of 7 cm which had previously been degreased, etched and desmutted was dried. A black modified acrylic lacquer (acrylic resin/nitrocellulose) enamel diluted with a thinner to an IHS cup consistency of 11 seconds was poured at five points into the surface of water slowly flowing in one direction to form five thin streaks of the enamel extending in the direction of the flow of water. The flow of water and pouring of the enamel were both terminated immediately before the front ends of the lines of the enamel arrived at the overflow end. The dried aluminum sheet was slowly dipped therein to deposit the enamel in a wood grain pattern on its surfaces. The sheet was drawn up and dried at 100° C. for 10 minutes. The sheet was soaked in an electrolytic bath containing boric acid in a strength of 20 g/l and caustic soda in a concentration of 1 g/l and maintained at 20° C., and electric current was supplied for 40 seconds at a current density of 2 A/dm$^2$ between the sheet and a stainless steel (SUS 304) counter electrode to form a barrier film. After this surface modification, the sheet was treated with an organic paint remover, Saprotite P-19 supplied by Chugai Kasei K. K. to remove the patterned mask coating, washed with water and then soaked in a 17.5 w/v% sulfuric acid electrolytic bath in which direct electric current was supplied at a current density of 1.2 A/dm$^2$ for 35 minutes between the sheet and an aluminum cathode to form an anodic oxide film in the surfaces of the sheet. The sheet was then, after washing with water, subjected to electrolysis by alternating current of a voltage of 18 volts for 3 minutes in a bath of the following composition.

| | | |
|---|---|---|
| Electrolytic bath: | Nickel sulfate (hexahydrate) | 30 g/l |
| | Magnesium sulfate (heptahydrate) | 15 g/l |
| | Boric acid | 20 g/l |
| | Ammonium sulfate | 30 g/l |
| | Sodium dithionite | 0.5 g/l |
| | pH | 5.6 |
| | Temperature | 20° C. |

Thus there was formed a pattern of the grain of wood comprising dark areas corresponding to the areas masked by the surface modification and light bronze areas corresponding to the unmasked areas.

EXAMPLE 2

The same aluminum sheet as used in Example 1 was subjected, in place of the surface modification by barrier film forming electrolysis in boric acid-caustic soda bath in Example 1, to a surface modification by electrolysis for 1 minute in a 15 g/l sulfuric acid bath at 20° C. by means of 23 V direct current imposed between the sheet and an aluminum cathode. The sheet was then treated with an organic paint remover, Saprotite p-19 supplied by Chugai kasei k. k. to remove the patterned mask coating, washed with water and soaked in a 17.5 w/v% sulfuric acid electrolytic bath in which electric current was supplied first at 21 V for 20 seconds and then at a direct current density of 1.2 A/dm$^2$ for 35 minutes between the sheet as anode and an aluminum counter electrode as cathode to perform anodic oxidation. The sheet was then treated in the same manner as in Example 1 to obtain a wood grain pattern comprising dark masked areas and light bronze unmasked areas.

EXAMPLE 3

An aluminum sheet applied with a mask coating in a wood grain pattern in the same manner as in Example 1 was subjected to etching at 60° C. for 3 minutes in a 70 g/l caustic soda bath to etch unmasked areas thereby to form difference in metallic luster between the masked and unmasked areas. The sheet was then processed in the same procedure as in Example 1 to obtain a finished sheet having a wood grain pattern exhibiting a stereographic effect in addition to the similar appearance as obtained in Example 1.

EXAMPLE 4

An aluminum sheet was processed in the same manner as in Example 1 until removal of mask coating and then subjected to anodic oxidation in an electrolyte containing 5 g/l of sulfuric acid and 100 g/l of sulfo-salicylic acid at 20° C., at a current density of 2 A/dm$^2$, for 35 minutes using an aluminum counter electrode as cathode to obtain a finished sheet having a wood grain pattern comprising dark masked areas and light amber unmasked areas.

EXAMPLE 5

Through surface modification to removal of mask coating there was repeated the same process as in Example 3, and then the so treated sheet was processed in the same manner as in Example 4 to obtain a wood grain pattern exhibiting, in addition to an appearance as obtained in Example 4, a stereographic effect.

EXAMPLE 6

The same procedure as in Example 2 was repeated except that there was used for surface modification a 20 g/l oxalic acid bath at a liquid temperature of 20° C. in place of a 15 g/l sulfuric acid bath to obtain a wood grain pattern wherein masked areas are dark and unmasked areas are light bronze.

What we claim is:

1. A method of forming a textured, colored pattern on the surface of an article made of aluminum or its alloys comprising:
   - dipping said article in a coating bath which includes a resinous coating material, selected from the group consisting of acrylic resins and alkyd resins, in the form of multilinear or multiannular patterns floated thereon to deposit a mask coating in a wood-grain pattern on a surface of said article;
   - applying an alkaline solution to said surface to deeply etch the unmasked areas to form a textured surface;
   - removing the mask coating; and
   - electrolytically coloring said surface, including both the etched and previously masked portions.

2. A method as claimed in claim 1, wherein the coating material is floated on water.

3. A method as claimed in claim 2, wherein a surface-active agent is incorporated into the water.

4. A method as claimed in claim 1, wherein the electrolytic coloring is performed by subjecting the masked and surface-modified article to an anodic oxidation in an acid electrolyte and then to an electrolysis in an acid electrolyte containing a metallic salt to form a colored oxide film.

5. A method as claimed in claim 1, wherein the electrolytic coloring is performed by an anodic oxidation in an organic acid electrolyte to form a colored oxide film.

6. An aluminum article produced by the method of claim 1, which has a close resemblance to a straight or cross grain of natural wood with a stereographic effect.

* * * * *